US011814764B2

(12) United States Patent
Matsuura et al.

(10) Patent No.: US 11,814,764 B2
(45) Date of Patent: Nov. 14, 2023

(54) NONWOVEN FABRIC FOR CURTAIN AND METHOD FOR MANUFACTURE THEREOF

(71) Applicant: Toray Industries, Inc., Tokyo (JP)

(72) Inventors: Hiroyuki Matsuura, Otsu (JP); Shinobu Mizogami, Otsu (JP); Ryoichi Hane, Otsu (JP)

(73) Assignee: Toray Industries, Inc., Tokyo (JP)

( * ) Notice: Subject to any disclaimer, the term of this patent is extended or adjusted under 35 U.S.C. 154(b) by 492 days.

(21) Appl. No.: 17/058,721

(22) PCT Filed: May 29, 2019

(86) PCT No.: PCT/JP2019/021388

§ 371 (c)(1),
(2) Date: Nov. 25, 2020

(87) PCT Pub. No.: WO2019/230837

PCT Pub. Date: Dec. 5, 2019

(65) Prior Publication Data

US 2021/0214871 A1 Jul. 15, 2021

(30) Foreign Application Priority Data

May 31, 2018 (JP) ..... 2018-104588

(51) Int. Cl.
*D04H 3/16* (2006.01)
*A47H 23/10* (2006.01)

(52) U.S. Cl.
CPC ..... *D04H 3/16* (2013.01); *A47H 23/10* (2013.01); *D10B 2503/02* (2013.01)

(58) Field of Classification Search
CPC ..... D04H 3/16; A47H 23/10; D10B 2503/02
See application file for complete search history.

(56) References Cited

U.S. PATENT DOCUMENTS

2010/0180558 A1 7/2010 Ito et al.
2017/0233913 A1* 8/2017 Shimada ..... H01M 50/414 429/253

FOREIGN PATENT DOCUMENTS

CN 101678255 A 3/2010
CN 102257199 A 11/2011
CN 102257201 A 11/2011
CN 103459696 A 12/2013
(Continued)

OTHER PUBLICATIONS

European Communication pursuant to Article 94(3) for European Application No. 19 810 193.3, dated Feb. 8, 2023, 4 pages.
(Continued)

*Primary Examiner* — Frank J Vineis
*Assistant Examiner* — Donald M Flores, Jr.
(74) *Attorney, Agent, or Firm* — RatnerPrestia

(57) ABSTRACT

A nonwoven fabric for curtain in an embodiment of the present invention is formed from fibers having a thermoplastic resin as a main component, said nonwoven fabric for curtain being characterized in that: in the surface of the nonwoven fabric, the fibers are fused together at points where the fibers intersect, and the fibers are mutually isolated at locations other than the intersecting points; and furthermore, the KES surface roughness SMD of at least one side of the sheet is 1.2 μm or less, and the longitudinal tearing strength per fabric weight is 0.50 or more.

4 Claims, 1 Drawing Sheet

(56) References Cited

FOREIGN PATENT DOCUMENTS

| | | | |
|---|---|---|---|
| EP | 1980308 | A1 | 10/2008 |
| EP | 2174703 | A1 | 4/2010 |
| EP | 2818229 | A1 | 12/2014 |
| JP | 2003275093 | A | 9/2003 |
| JP | 3712115 | B2 | 11/2005 |
| JP | 2006296463 | A | 11/2006 |
| JP | 2007284859 | A | 11/2007 |
| JP | 2014040677 | A | 3/2014 |
| JP | 2014161712 | A | 9/2014 |
| KR | 20170001050 | A | 1/2017 |
| WO | 2016031693 | A1 | 3/2016 |

OTHER PUBLICATIONS

International Search Report and Written Opinion for International Application No. PCT/JP2019/021388, dated Jul. 2, 2019, 4 pages.
Japanese Explanation of Circumstances Concerning Accelerated Examination for Application No. 2020-522267, dated Apr. 6, 2022 with translation, 5 pages.
Chinese Office Action with Search Report for Chinese Application No. 201980035848.9, dated Sep. 18, 2021, with translation, 14 pages.
Extended European Search Report for European Application No. 19 810 193.3, dated Oct. 1, 2021, 8 pages.

* cited by examiner

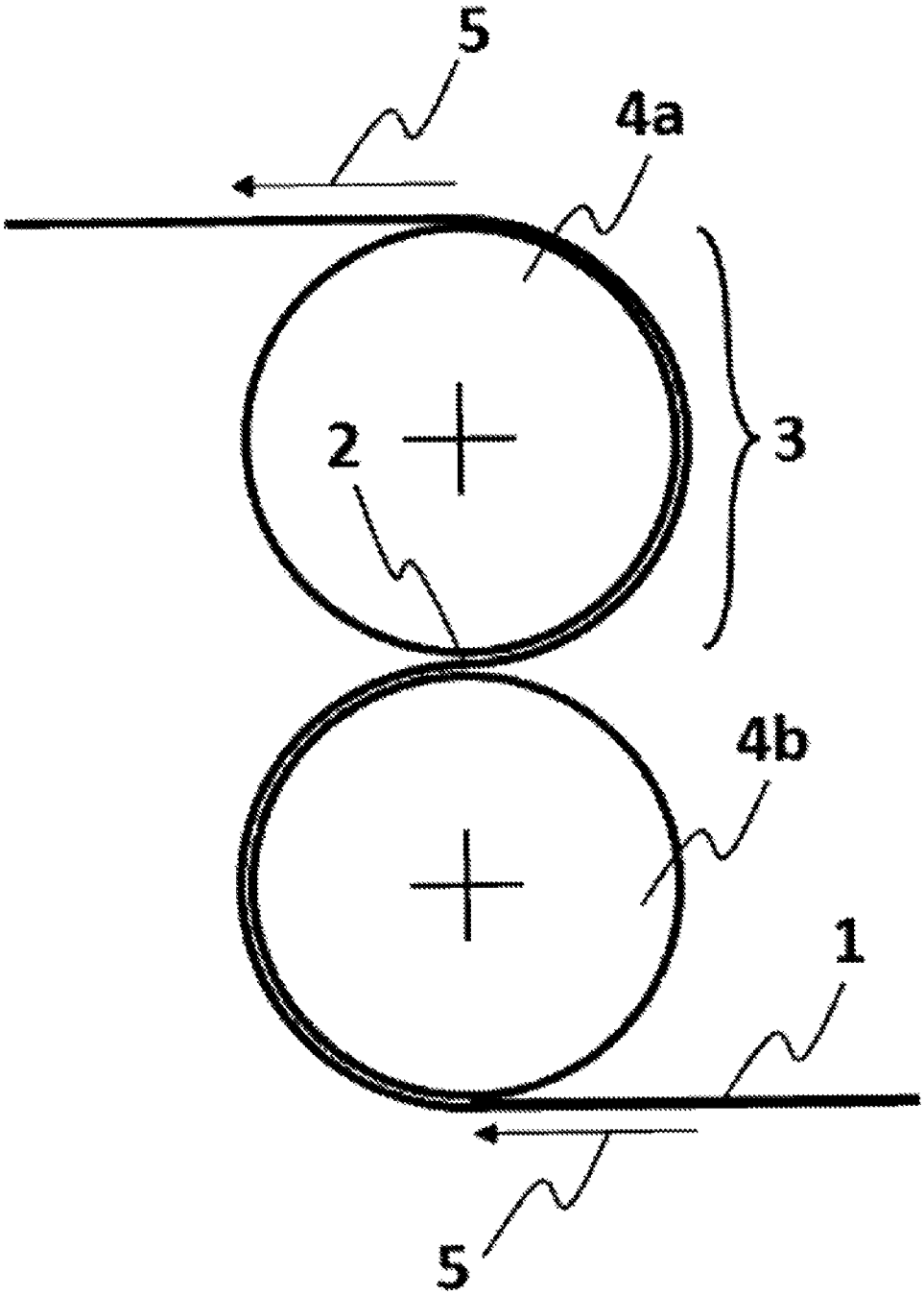
5
4a
3
2
4b
1
5

NONWOVEN FABRIC FOR CURTAIN AND METHOD FOR MANUFACTURE THEREOF

CROSS REFERENCE TO RELATED APPLICATIONS

This is the U.S. National Phase application of PCT/JP2019/021388, filed May 29, 2019, which claims priority to Japanese Patent Application No. 2018-104588, filed May 31, 2018, the disclosures of each of these applications being incorporated herein by reference in their entireties for all purposes.

FIELD OF THE INVENTION

The present invention relates to a nonwoven fabric for curtains to be disposed indoors in buildings and to a method for producing the nonwoven fabric.

BACKGROUND OF THE INVENTION

Curtains such as blind curtains, roll-up curtains, and pleated curtains have conventionally been used in houses, offices, etc. Curtains are required to have functions such as light-shielding properties, privacy securement, cold protection, heat shielding, and sound insulation, and fabrics frequently used for the curtains are woven fabrics, nonwoven fabrics, etc. Of these, nonwoven fabrics configured of thermoplastic fibers are particularly advantageous in that these nonwoven fabrics are easy to produce and to composite with other materials and it is easy to impart various properties thereto according to need. Many proposals have hence been made on curtain bases including nonwoven fabrics. For example, an interior fibrous product which is constituted of a spunbonded nonwoven fabric made of a poly(lactic acid)-based polymer and has flame retardancy has been proposed (see Patent Document 1).

Meanwhile, a nonwoven fabric for curtains which is not an embossed fabric and is excellent in terms of lightweight property and non-bulkiness in an undrawn state has been proposed (see Patent Document 2).

Furthermore, a nonwoven fabric for curtains excellent in design attractiveness which has high web evenness and has an unryu (cloud-dragon) pattern has been proposed (see Patent Document 3).

PATENT LITERATURE

Patent Document 1: JP-A-2003-275093
Patent Document 2: JP-A-2006-296463
Patent Document 3: JP-A-2014-161712

SUMMARY OF THE INVENTION

However, the technique disclosed in Patent Document 1 has problems in that since the fibrous product is constituted of a spunbonded nonwoven fabric made of a poly(lactic acid)-based polymer, this fibrous product has poor mechanical strength and is prone to break when used as a curtain and that since the fibrous product has been embossed, it has poor printability.

The technique disclosed in Patent Document 2 has a problem in that since the nonwoven fabric is a melt-blown nonwoven fabric in which the filaments have been unidirectionally aligned, this nonwoven fabric has lower mechanical strength than spunbonded nonwoven fabrics and has poor mechanical strength in directions not along the alignment direction.

Furthermore, the technique disclosed in Patent Document 3 has a problem in that since the nonwoven fabric is a short-fiber nonwoven fabric, this nonwoven fabric has poor mechanical strength and is fuzz-prone.

An object of the present invention is to provide a nonwoven fabric for curtains which hardly produces fuzz, has moderate light-shielding properties and light-transmitting properties, and has excellent mechanical strength.

The present inventors diligently made investigations in order to accomplish the object and, as a result, have discovered a nonwoven fabric which hardly produces fuzz, has moderate light-shielding properties and light-transmitting properties, and has excellent mechanical strength and which is suitable for use as a nonwoven fabric for curtains. The inventors have further discovered a method for producing the nonwoven fabric.

The nonwoven fabric for curtains according to one aspect of the present invention, for overcoming those problems, is a nonwoven fabric for curtains including fibers including a thermoplastic resin as a main component, in which, in a surface of the nonwoven fabric, the fibers are fused to each other in intersections of the fibers and the fibers are apart from each other in parts other than the intersections, at least one sheet surface of the nonwoven fabric has a KES surface roughness SMD of 1.2 μm or less, and the nonwoven fabric has a machine-direction tear strength per mass per unit area of 0.50 N/(g/m$^2$) or higher.

A preferred embodiment of the nonwoven fabric for curtains of the present invention has a mass per unit area of 50 g/m$^2$ or larger and 100 g/m$^2$ or smaller, a thickness of 0.10 mm or larger and 0.25 mm or smaller, an air permeability of 30 cc/cm$^2$/sec or higher and 120 cc/cm$^2$/sec or lower, and a coefficient of variation in transmitted-light luminance of 10% or higher and 30% or lower.

A preferred embodiment of the nonwoven fabric for curtains of the present invention is a spunbonded nonwoven fabric including long fibers.

A method for producing the nonwoven fabric for curtains according to another aspect of the present invention includes a step of thermocompression-bonding a fibrous web at a linear pressure of 500 N/cm or higher and 1,100 N/cm or lower with a pair of flat rolls heated to a temperature lower by 30° C. or higher and 120° C. or lower than a melting point of a thermoplastic resin which has the lowest melting point and constitutes a surface of the fibers to obtain a nonwoven fabric, and then successively bringing the nonwoven fabric into contact with the flat roll for a certain time period.

For the present invention, it is possible to obtain a nonwoven fabric for curtains which hardly produces fuzz, has moderate light-shielding properties and light-transmitting properties, and has excellent mechanical strength, because this is a nonwoven fabric including fibers including a thermoplastic resin as a main component, in which, in at least one surface of the nonwoven fabric, all intersections of surface fibers are fused to each other, at least one sheet surface of the nonwoven fabric has a surface roughness SMD determined by a KES method of 1.2 μm or less, and the nonwoven fabric has a machine-direction tear strength per mass per unit area of 0.50 N/(g/m$^2$) or higher.

BRIEF DESCRIPTION OF DRAWING

The FIGURE is a diagrammatic view showing a heat treatment of a fibrous web with flat rolls.

DETAILED DESCRIPTION OF EMBODIMENTS OF THE INVENTION

The nonwoven fabric for curtains according to one aspect of the present invention is a nonwoven fabric including fibers including a thermoplastic resin as a main component, and has a surface state in which the fibers have no filmy portion due to fusion among fibers and remain fibrous without ruggedness due to embossing. In addition, at least one sheet surface of the nonwoven fabric has a surface roughness SMD, as determined by a KES method (Kawabata Evaluation System), of 1.2 μm or less and this nonwoven fabric has a machine-direction tear strength per mass per unit area of 0.50 N/(g/m$^2$) or higher.

This nonwoven fabric is described in detail below.

(Thermoplastic Resin)

It is important that the nonwoven fabric for curtains according to one aspect of the present invention is a nonwoven fabric including fibers including a thermoplastic resin as a main component.

Examples of the thermoplastic resin include polyesters, polyamides, polyolefins, and mixtures or copolymers of two or more of these. Polyesters are preferred of these because polyesters are superior in mechanical strength and durability such as heat resistance, water resistance, and chemical resistance.

Polyesters are polymers produced from an acid ingredient and an alcohol ingredient. As the acid ingredient, use can be made of an aromatic carboxylic acid such as terephthalic acid, isophthalic acid, or phthalic acid, an aliphatic dicarboxylic acid such as adipic acid or sebacic acid, an alicyclic dicarboxylic acid such as cyclohexanecarboxylic acid, etc. As the alcohol ingredient, use can be made of ethylene glycol, diethylene glycol, polyethylene glycol, etc.

Examples of the polyesters include poly(ethylene terephthalate), poly(butylene terephthalate), poly(trimethylene terephthalate), poly(ethylene naphthalate), poly(lactic acid), poly(butylene succinate), and copolymers of two or more of these.

A crystal nucleus agent, flatting agent, lubricant, pigment, fungicide, anti-fungus agent, flame retarder, hydrophilization agent, etc. may be added to the nonwoven fabric for curtains according to one aspect of the present invention. Especially in the case of forming a long-fiber nonwoven fabric by thermocompression-bonding, it is preferred to add a metal oxide, e.g., titanium oxide, which has the effect of enhancing the thermal conductivity and thereby improving the bondability of the long-fiber nonwoven fabric and to add an aliphatic bisamide, e.g., ethylenebisstearamide, and/or an alkyl-substituted aliphatic monoamide, which has the effect of enhancing the releasability of the web from the thermocompression-bonding rolls and thereby improving bonding stability. Such various additives may be caused to be present in thermoplastic continuous fibers or on the surface of the thermoplastic continuous fibers.

(Fibers Including Thermoplastic Resin as Main Component)

It is preferable that the fibers including a thermoplastic resin as a main component in the present invention are composite fibers each including a high-melting-point polymer and a low-melting-point polymer disposed around the high-melting-point polymer, the low-melting-point polymer having a lower melting point than the high-melting-point polymer.

In cases when such composite fibers are used, the thermoplastic continuous fibers can be tenaciously bonded to each other within the nonwoven fabric by thermocompression-bonding, making it possible to obtain surface smoothness, inhibit producing fuzz, and attain improved mechanical strength which is required of nonwoven fabrics for use as curtains.

Besides bringing about the tenacious bonding between the filaments constituting the nonwoven fabric, use of such composite fibers results in a larger number of bonding sites in the nonwoven fabric than in nonwoven fabrics configured of a mixture of fibers differing in melting point. Hence, the obtained nonwoven fabric for curtains has improved dimensional stability and improved durability.

The term "main component" herein means a component which accounts for 50% by mass or more of the components of the composite fibers.

The difference in melting point between the high-melting-point polymer and the low-melting-point polymer is preferably 10° C. or larger and 140° C. or smaller. By regulating the difference in melting point to 10° C. or larger, more preferably 20° C. or larger, still more preferably or larger, desired thermal bondability can be obtained. By regulating the difference in melting point to 140° C. or smaller, more preferably 120° C. or smaller, still more preferably 100° C. or smaller, the low-melting-point polymer ingredient can be inhibited from fusing to the thermocompression-bonding rolls during thermocompression-bonding to reduce the production efficiency.

The melting point of the high-melting-point polymer in the composite fibers is preferably 160° C. or higher and 320° C. or lower. In cases when the melting point thereof is 160° C. or higher, more preferably 170° C. or higher, still more preferably 180° C. or higher, the composite fibers have excellent shape stability even in processing steps in which heat is applied thereto. Meanwhile, in cases when the melting point of the high-melting-point polymer is 320° C. or lower, more preferably 300° C. or lower, still more preferably 280° C. or lower, melting in producing the long-fiber nonwoven fabric can be inhibited from consuming a large amount of heat energy to reduce the production efficiency.

Meanwhile, the melting point of the low-melting-point polymer in the composite fibers is preferably 150° C. or higher and 310° C. or lower, provided that the difference in melting point between the high-melting-point polymer and the low-melting-point polymer is ensured. In cases when the melting point thereof is 150° C. or higher, more preferably 160° C. or higher, still more preferably 170° C. or higher, the composite fibers have excellent shape stability even in processing steps in which heat is applied thereto. Meanwhile, in cases when the melting point of the low-melting-point polymer is 310° C. or lower, more preferably 290° C. or lower, still more preferably 270° C. or lower, melting in producing the long-fiber nonwoven fabric can be inhibited from consuming a large amount of heat energy to reduce the production efficiency.

Examples of combinations of the high-melting-point polymer and the low-melting-point polymer (high-melting-point polymer/low-melting-point polymer) include poly (ethylene terephthalate)/poly(butylene terephthalate), poly (ethylene terephthalate)/poly(trimethylene terephthalate), poly(ethylene terephthalate)/poly(lactic acid), and poly(ethylene terephthalate)/poly(ethylene terephthalate) copolymer. Preferred comonomer ingredients for the poly(ethylene terephthalate) copolymer include isophthalic acid.

In the present invention, the melting point of a thermoplastic resin is a value measured in the following manner.

(1) Using a differential scanning calorimeter, a measurement is conducted once under the following conditions. As the differential scanning calorimeter is used "Q100", manufacture by TA Instruments.

Measurement atmosphere: nitrogen stream (150 mL/min)
Temperature range: 30-350° C.
Heating rate: 20° C./min
Sample amount: 5 mg (2) An average of endothermic-peak temperatures is calculated, and the average is taken as the melting point of the measurement target. However, in the case where a resin which has not been subjected to fiber formation shows a plurality of endothermic peaks, the highest peak temperature is taken as the melting point of the resin. In the case of examining fibers, a measurement is conducted in the same manner, and the melting points of the components are estimated from the plurality of endothermic peaks. In this case, composite fibers show endothermic peaks including an endothermic peak (A) located on the most higher-temperature side and a peak (endothermic peak (B)) which appears on the shorter elapsed-time side (the side where a peak appears earlier) and which is the second highest next to the endothermic peak located on the most higher-temperature side; the endothermic peak (A) indicates the melting point of the high-melting-point polymer, and the endothermic peak (B) indicates the melting point of the low-melting-point polymer.

The proportion of the low-melting-point polymer in the composite fibers is preferably 10% by mass or higher and 70% by mass or lower. By regulating the proportion thereof to 10% by mass or higher, more preferably 15% by mass or higher, still more preferably 20% by mass or higher, desired thermal bondability can be obtained. By regulating the proportion thereof to 70% by mass or lower, more preferably 60% by mass or lower, still more preferably 50% by mass or lower, the composite fibers can be inhibited from being excessively fused to result in a decrease in tear strength.

Examples of compositing configurations of the composite fibers include a concentric core-sheath type, an eccentric core-sheath type, and a sea-island type. Preferred of these is the concentric core-sheath type, in particular, the configuration in which the low-melting-point polymer is a sheath component, because such fibers can be tenaciously bonded to each other by thermocompression-bonding.

Examples of the cross-sectional shape of the fibers including a thermoplastic resin as a main component include a circular shape, low-profile shapes, polygonal shapes, multifoil shapes such as an X shape and a Y shape, and hollow shapes. In the case where the composite fibers described above have a cross-sectional shape of a deformed shape, it is preferable that the low-melting-point polymer ingredient is present near the outer periphery of the fiber cross-section so as to contribute to the thermocompression-bonding.

The fibers of the present invention, which include a thermoplastic resin as a main component, preferably have an average single-fiber diameter of 10 μm or larger and 24 μm or smaller. By regulating the average single-fiber diameter thereof to preferably 10 μm or larger, more preferably 11 μm or larger, still more preferably 12 μm or larger, a nonwoven fabric excellent in terms of evenness in mass per unit area and of mechanical strength can be obtained.

Meanwhile, by regulating the average single-fiber diameter thereof to preferably 24 μm or smaller, more preferably 23 μm or smaller, still more preferably 22 μm or smaller, a nonwoven fabric having moderate light-shielding properties and light-transmitting properties can be obtained.

In the present invention, the average single-fiber diameter (μm) of the fibers including a thermoplastic resin as a main component is a value calculated in the following manner.

(1) Ten sample pieces (100×100 mm) are randomly taken out of a nonwoven fabric.

(2) Photographs of surfaces thereof are taken with a microscope at a magnification of 500 to 3,000 times. Ten single fibers are selected from each sample, and the diameter of each of a total of 100 single fibers is measured.

(3) An arithmetic average of the measured values for the 100 fibers is rounded off to the nearest whole number to calculate the average single-fiber diameter (μm).

(Nonwoven Fabric for Curtains)

For the nonwoven fabric for curtains according to one aspect of the present invention, it is important that fibers have been fused to each other in fiber intersections and fibers are apart from each other in parts other than the intersections, in a surface of the nonwoven fabric. The wording "fibers are apart from each other" means that the fibers have not been fused to each other. This state in which fibers have not been excessively fused to each other to form filmy portions enables the nonwoven fabric for curtains to retain suitable air permeability. Furthermore, since the fibers other than the intersections of fibers have not been fused to each other to become filmy after the thermal fusion and remain fibrous, this nonwoven fabric has excellent mechanical strength which enables the nonwoven fabric to withstand long-term use as a curtain. In addition, since the fibers have been fused only at the intersections, this nonwoven fabric for curtains can be inhibited from producing fuzz and can have excellent printability.

In the present invention, presence or absence of fusion of fibers other than the intersections in the surface of the nonwoven fabric for curtains can be assessed in the following manner.

(1) Ten sample pieces (100×100 mm) are randomly taken out of the nonwoven fabric for curtains.

(2) A photomicrograph of a surface of each sample is taken with a microscope at a magnification of 500 to 3,000 times.

(3) All the fibers in each photomicrograph are examined. In cases when two or more fibers have been fused in any part other than the intersections to form a filmy portion without being apart from each other, then this nonwoven fabric is regarded as having portions where fibers have been fused to each other.

It is important.

It is important for the nonwoven fabric for curtains according to one aspect of the present invention that one sheet surface has a surface roughness SMD, as determined by a KES method, of 1.2 μm or less.

Since surface roughness SMD determined by the KES-method on one sheet surface is 1.2 μm or less, preferably 1.1 μm or less, more preferably 1.0 μm or less, this surface is not fuzz-prone and is smooth, and can hence be made to have enhanced design attractiveness. Such surface roughness SMD determined by the KES-method can be attained by not forming ruggedness by embossing. Further, the surface roughness SMD can be regulated by appropriately adjusting conditions for processing a fibrous web with a pair of flat rolls.

In the present invention, surface roughness SMD determined by the KES-method is a value determined in the following manner.

(1) Three specimens having dimensions of width 200 mm×200 mm are taken out of a nonwoven fabric along the width direction of the nonwoven fabric at the same intervals.

(2) Each specimen is set on a sample table so that a load of 400 g is imposed thereon.

(3) A contact sensor for surface roughness measurement (material, piano wire having a diameter of 0.5 mm; contact length, 5 mm) on which a load of 10 gf is being imposed is used to scan the surface of the specimen to determine an average deviation of surface ruggedness.

(4) The measurement is made on each of all the specimens in the machine direction (longitudinal direction of the nonwoven fabric) and the transverse direction (width direction of the nonwoven fabric). The resultant six average deviations are averaged and the average is rounded off to the nearest tenth to obtain the surface roughness SMD (μm).

It is important for the nonwoven fabric for curtains according to one aspect of the present invention that the nonwoven fabric has a machine-direction tear strength per mass per unit area of 0.50 N/(g/m$^2$) or higher. Since the machine-direction tear strength per mass per unit area thereof is 0.50 N/(g/m$^2$) or higher, preferably 0.60 N/(g/m$^2$) or higher, more preferably 0.70 N/(g/m$^2$) or higher, this nonwoven fabric has excellent mechanical strength and shows excellent durability when used as a curtain.

The machine-direction tear strength is a value determined using a constant-elongation-speed tensile tester (e.g., "RTG-1250", manufactured by Baldwin Corp.) in the following manner, in accordance with a) Trapezoid Method of 6.4 "Tear Strength" of JIS L1913 (year 2010) "Test Method for General-purpose Nonwoven Fabrics".

(1) Ten specimens having a length of 150 mm and a width of 75 mm are taken out of a nonwoven fabric along the transverse direction (width direction) of the nonwoven fabric.

(2) A mark of an isosceles trapezoid is put on each specimen, and a 15-mm incision is formed at the center of the shorter side of the mark so as to be perpendicular to the shorter side.

(3) The specimen is attached to chucks of the constant-elongation-speed tensile tester along the mark at a chuck-to-chuck distance of 25 mm so that the shorter side of the trapezoid is tense and the longer side is loose.

(4) The specimen is torn under the conditions of a pulling speed of 100±10 mm/min, and a maximum load (N) during the tearing is taken as a tear strength (N). An average for the ten specimens is calculated.

(5) The calculated tear strength (N) is divided by the mass per unit area (g/m$^2$) and the quotient is rounded off to the nearest whole number.

It is preferable that the nonwoven fabric for curtains according to one aspect of the present invention has a mass per unit area of 50 g/m$^2$ or larger and 100 g/m$^2$ or smaller. By regulating the mass per unit area of the nonwoven fabric to preferably 100 g/m$^2$ or smaller, more preferably 95 g/m$^2$ or smaller, still more preferably 90 g/m$^2$ or smaller, this nonwoven fabric can be made to have excellent handleability when installed and have sufficient light-shielding properties.

Meanwhile, by regulating the mass per unit area of the nonwoven fabric to preferably g/m$^2$ or larger, more preferably 55 g/m$^2$ or larger, still more preferably 60 g/m$^2$ or larger, this nonwoven fabric can be rendered excellent in terms of lightweight property and light-transmitting property.

In the present invention, the mass per unit area of a laminated nonwoven fabric is a value determined in accordance with JIS L1913 (year 2010) "6.2 Mass per Unit Area" in the following manner.

(1) Three specimens having dimensions of 25 cm×25 cm are taken out per 1-m width of a sample.

(2) The mass (g) of each specimen in the normal state is measured.

(3) An average of the measured masses is expressed in terms of mass (g/m$^2$) per 1 m$^2$.

It is preferable that the nonwoven fabric for curtains according to one aspect of the present invention has a thickness of 0.10 mm or larger and 0.25 mm or smaller. In cases when the thickness of the nonwoven fabric is 0.25 mm or smaller, more preferably 0.24 mm or smaller, still more preferably 0.23 mm or smaller, this nonwoven fabric is not fuzz-prone and has surface smoothness, and thus can be made to have enhanced design attractiveness.

Meanwhile, in cases when the thickness of the nonwoven fabric is 0.10 mm or larger, more preferably 0.11 mm or larger, still more preferably 0.12 mm or larger, this nonwoven fabric has surface smoothness with no filmy surface portions and can hence be made to have enhanced design attractiveness.

In the present invention, the thickness (mm) of a nonwoven fabric is a value determined in accordance with JIS L1906 (year 2000) "5.1" in the following manner.

(1) Pressing disks having a diameter of 10 mm are used to measure the thickness of each of ten portions per 1 m lying along the width direction of the nonwoven fabric at the same intervals, under a load of 10 kPa, the measurement being made in 0.01 mm unit.

(2) An average for the ten portions is rounded off to the nearest thousandth.

It is preferable that the nonwoven fabric for curtains according to one aspect of the present invention has an air permeability of 30 cc/cm$^2$/sec or higher and 120 cc/cm$^2$/sec or lower.

By regulating the air permeability of the nonwoven fabric to 120 cc/cm$^2$/sec or lower, more preferably 115 cc/cm$^2$/sec or lower, still more preferably 110 cc/cm$^2$/sec or lower, this nonwoven fabric can be made to have sufficient light-shielding properties.

Meanwhile, by regulating the air permeability of the nonwoven fabric to 30 cc/cm$^2$/sec or higher, more preferably 35 cc/cm$^2$/sec or higher, still more preferably 40 cc/cm$^2$/sec or higher, this nonwoven fabric can be made to have surface smoothness with no filmy surface portions and can hence be made to have enhanced design attractiveness.

In the present invention, the air permeability of a nonwoven fabric is a value determined in accordance with "6.8.1 Frazier Method" of JIS L1913 (year 2010) in the following manner.

(1) Ten specimens having dimensions of 15 cm×15 cm are cut out of the nonwoven fabric.

(2) Each specimen is examined at a barometric pressure of 125 Pa.

(3) An average of the obtained values is rounded off to the nearest whole number to calculate the air permeability.

It is preferable that the nonwoven fabric for curtains according to one aspect of the present invention has a coefficient of variation in transmitted-light luminance of 10% or higher and 30% or lower.

By regulating the coefficient of variation in transmitted-light luminance of the nonwoven fabric to 30% or lower, more preferably 25% or lower, still more preferably 20% or lower, this nonwoven fabric can be made to have sufficient light-shielding properties when used as a nonwoven fabric for curtains.

Meanwhile, by regulating the coefficient of variation in transmitted-light luminance of the nonwoven fabric to 10% or higher, more preferably 15% or higher, still more preferably 20% or higher, this nonwoven fabric can be made to have sufficient light-transmitting properties when used as a nonwoven fabric for curtains.

The coefficient of variation in transmitted-light luminance of a nonwoven fabric in the present invention is a value determined in the following manner.

(1) Three specimens having dimensions of 15 cm×15 cm are cut out of the nonwoven fabric.

(2) Each specimen is superposed on a sheet of black drawing paper as a background and set on a scanner (e.g., GT-X750, manufactured by EPSON Corp.).

(3) The specimen is scanned with the image scanner to obtain an image file with a resolution of 1,200 dpi.

(4) The obtained image file is processed with an image processing software (e.g., "AT-Image Ver. 3.2") to obtain numerical values of average luminance. A coefficient of variation is determined from a standard deviation of these numerical values and rounded off to the nearest whole number to calculate the coefficient of variation in transmitted-light luminance.

(Method for Producing the Nonwoven Fabric for Curtains)

Next, a method for producing the nonwoven fabric for curtains according to one aspect of the present invention is explained.

Examples of methods for producing the nonwoven fabric for curtains according to one aspect of the present invention include a spunbonding method, a flash spinning method, a wet-forming method, a card method, and an air-laid method.

Spunbonded nonwoven fabrics produced by the spunbonding method among these are one of preferred examples. The spunbonded nonwoven fabric, which is a long-fiber nonwoven fabric configured of thermoplastic filaments, not only is excellent in terms of production efficiency but also can be inhibited, when used as a nonwoven fabric for curtains, from producing fuzz which is prone to occur in using short-fiber nonwoven fabrics and prevent generation of partial bonding failure or processing failure. In addition, the spunbonded nonwoven fabric is advantageously used also from the standpoint that this nonwoven fabric has better mechanical strength and, when used as a nonwoven fabric for curtains, can give articles having excellent durability.

In the case of using composite fibers, e.g., the core-sheath type, as fibers for constituting the nonwoven fabric in the present invention, an ordinary compositing method can be employed for producing the composite fibers.

Thermoplastic polymers are melt-extruded from a spinneret and then drawn and stretched with an ejector to obtain thermoplastic continuous filaments. The thermoplastic continuous filaments are sent out from a nozzle, electrostatically spread, and then deposited on a moving collection plane to form a fibrous web.

In this operation, the nozzle is continuously rocked over a given angle, which is 15 degrees or larger, preferably 20 degrees or larger, more preferably 25 degrees or larger, on each of the left-hand side and the right-hand side to the web running direction. The filaments pass through the nozzle being continuously rocked, and are subsequently electrostatically spread by the charging means to give a fibrous web. Thus, not only this web has a reduced content of fiber bundles but also the filaments in the web tend to be obliquely aligned in transverse direction with large angles to the longitudinal direction of the web. More specifically, the filaments have a fiber orientation degree of 35 degrees or more and 70 degrees or less. As a result, the fibers have an increased surface area per unit weight and this fibrous web gives a nonwoven fabric having improved evenness in mass per unit area and improved machine-direction tear strength.

When the nozzle rocking angle to the web running direction is 60 degrees or less, more preferably 55 degrees or less, still more preferably 50 degrees or less, the occurrence of defects, e.g., web curling can be inhibited during the formation of a fibrous web by depositing the filaments on a moving collection plane.

Methods for charging the thermoplastic continuous filaments are not limited at all. However, charging by corona discharge and charging by friction with a metal are preferred.

The fibrous web is subjected to a press-bonding treatment with a pair of flat rolls and is then kept being pressed against one of the flat rolls for a given time period to smooth the one surface, thereby forming a nonwoven fabric for curtains.

The smoothing treatment with a flat roll is not limited at all so long as the flat roll is kept in contact with the fibrous web. However, preferred is a heat treatment in which the flat roll heated to a given temperature is brought into contact with the fibrous web.

The surface temperature of the flat roll in this heat treatment is lower by preferably or higher and 120° C. or lower, more preferably 40° C. or higher and 110° C. or lower, most preferably 50° C. or higher and 100° C. or lower, than the melting point of the polymer which has a lowest melting point and constitutes the filaments lying in the fibrous web surface. That is, in cases when the melting point is expressed by (Tm), the surface temperature of the flat roll is preferably (Tm-120°) C. or higher and (Tm-30°) C. or lower, more preferably (Tm-110°) C. or higher and (Tm-40°) C. or lower, most preferably (Tm-100°) C. or higher and (Tm-50°) C. or lower.

In case where the surface temperature of the flat roll is lower than (Tm-120°) C., the heat treatment of the fibrous web may be insufficient and this may pose problems in that a desired sheet thickness is not obtained, the bonding is insufficient, and surface smoothness is not obtained. Such a low roll surface temperature is hence undesirable. Meanwhile, in case where the surface temperature of the flat roll is higher than (Tm-30°) C., the heat treatment may be excessive and this brings constituent fibers in a surface-layer portion into a fused state and makes it impossible to obtain sufficient mechanical strength. Such a high roll surface temperature is hence undesirable.

The time period during which the flat roll is kept in contact with the fibrous web to heat-treat the fibrous web is preferably in the range of 0.01 seconds or longer and 10 seconds or shorter. In cases when the heat treatment period is 0.01 second or longer, the effect of heat-treating the nonwoven fabric is sufficiently obtained and the heat treatment is not too weak, thereby obtaining sufficient mechanical strength. Meanwhile, in cases when the heat treatment period is 10 seconds or shorter, the heat treatment is not excessive and the tear strength is not lowered. The heat treatment period is more preferably 0.02 seconds or longer and 9 seconds or shorter, still more preferably 0.03 seconds or longer and 8 seconds or shorter.

In the method for producing the nonwoven fabric for curtains according to one aspect of the present invention, the smoothing treatment with flat rolls, for smoothing one surface of the sheet, is most preferably conducted by a method in which after a nonwoven fabric is formed by heat-press-bonding the fibrous web with a pair of flat rolls, this nonwoven fabric after the heat-press-bonding part is successively brought into contact with one of the flat rolls. That is, it is important to employ a method in which the fibrous web is heat-press-bonded with a pair of flat rolls in a heat-press-bonding part to form a nonwoven fabric and one surface of this nonwoven fabric after the heat-press-bonding part is successively brought into contact with one of the flat rolls to give a heat treatment thereto.

Methods for bringing the nonwoven fabric into contact with one of the flat rolls are not limited to specific ones so long as the nonwoven fabric after the heat-press-bonding part can be successively brought into contact with one of the flat rolls and heat-treated thereby. Generally employed is a method in which the fibrous web is heat-press-bonded in a heat-press-bonding part between a pair of flat rolls and is then brought into contact with one of the flat rolls in a contact part having a given length. For example, use may be made of a method in which, as shown in the FIGURE, the fibrous web is wound around a pair of flat rolls so that the wound fibrous web is in the shape of the letter S (or inverted S).

The linear pressure in press-bonding the fibrous web with a pair of flat rolls is preferably in the range of 500 N/cm or higher and 1,100 N/cm or lower, more preferably in the range of 510 N/cm or higher and 1,090 N/cm or lower. In cases when the linear pressure is 500 N/cm or higher, this linear pressure is sufficient for sheet formation. In cases when the linear pressure is 1,100 N/cm or lower, the fibers are prevented from being too strongly bonded to each other and hence the tear strength of the obtained nonwoven fabric is not lowered.

It is preferable that the successive contact of the nonwoven fabric with a flat roll after the heat-press-bonding part is conducted while a tension of 5 N/m or higher and 200 N/m or lower is kept being applied to the nonwoven fabric in the running direction of the nonwoven fabric. Tensions of 5 N/m or higher are preferred because the nonwoven fabric tends less to wind around the flat roll. Tensions of 200 N/m or lower are preferred because the nonwoven fabric is less apt to break. A more preferred range of the tension is 8 N/m or higher and 180 N/m or lower.

In successively bringing the nonwoven fabric into contact with the flat roll after the heat-press-bonding part, the contact distance is preferably in the range of 40 cm or longer and 250 cm or shorter. In cases when the contact distance is 40 cm or longer, a sufficient smoothing effect is obtained to yield a nonwoven fabric having excellent printability. In cases when the contact distance is 250 cm or shorter, the nonwoven fabric is prevented from being excessively heat-treated and thereby having reduced tear strength. A more preferred range of the contact distance is 50 cm or longer and 200 cm or shorter.

EXAMPLES

The nonwoven fabric for curtains according to one aspect of the present invention and the method for producing the nonwoven fabric are explained below in detail on the basis of Examples. Properties for which determination methods are not particularly described were determined by the methods described hereinabove.

[Determination Methods]

(1) Intrinsic Viscosity (IV):

The intrinsic viscosity IV of a poly(ethylene terephthalate) resin was determined by the following method. 8 g of a sample was dissolved in 100 mL of o-chlorophenol. Viscosity measurements were made at a temperature of 25° C. using an Ostwald viscometer, and a relative viscosity $\eta_r$ was determined using the following equation.

$$*\eta_r=\eta/\eta_0=(t\times d)/(t_0\times d_0)$$

($\eta$ represents the viscosity of the polymer solution; $\eta_0$ represents the viscosity of the o-chlorophenol; t represents the falling time (sec) of the solution; d represents the density (g/cm$^3$) of the solution; to represents the falling time (sec) of the o-chlorophenol; and do represents the density (g/cm$^3$) of the o-chlorophenol.)

Subsequently, the intrinsic viscosity (IV) was calculated from the relative viscosity $\eta_r$ using the following equation.

$$\text{Intrinsic viscosity (IV)}=0.0242\eta_r+0.2634$$

(2) Melting Point (° C.):

The melting point of a thermoplastic resin used was determined by examining the thermoplastic resin with a differential scanning calorimeter (Q100, manufactured by TA Instruments) under the conditions shown above, calculating an average of endothermic-peak temperatures, and taking the average as the melting point of the measurement target.

(3) Surface Roughness SMD (μm) Determined by KES-Method of Nonwoven Fabric for Curtains:

Automatic surface analyzer KES-FB4-AUTO-A, manufactured by Kato Tech Co., Ltd., was used to determine the surface roughness of the surface on the side reverse from the collection-net surface.

(4) Tear Strength (N) of Nonwoven Fabric for Curtains:

"RTG-1250", manufactured by Baldwin Corp., was used as a constant-elongation-speed tensile tester.

(5) Air Permeability (cc/cm$^2$/sec) of Nonwoven Fabric for Curtains:

Air permeability tester FX3300, manufactured by TEX-TEST AG, was used for an air permeability test.

(6) Coefficient of Variation in Transmitted-Light Luminance of Nonwoven Fabric

The coefficient of variation in transmitted-light luminance was determined using "GT-X750", manufactured by EPSON Corp., as a scanner and "AT-Image Ver. 3.2" as an image processing software.

Example 1

(Fibrous Web)

Composite fibers formed from a core ingredient and a sheath ingredient were used as fibers including a thermoplastic resin as a main component. The thermoplastic resins shown below were used.

Core Ingredient (high-melting-point long fibers): A poly (ethylene terephthalate) resin having an intrinsic viscosity (IV) of 0.65 and a melting point of 260° C. and containing 0.3% by mass of titanium oxide, the resin having been dried to a water content of 50 ppm or less.

Sheath Ingredient (low-melting-point long fibers): A poly (ethylene terephthalate) copolymer resin having an intrinsic viscosity (IV) of 0.66, a copolymerization ratio of isophthalic acid of 10% by mole and a melting point of 230° C., and containing 0.2% by mass of titanium oxide, the resin having been dried to a water content of 50 ppm or less.

The core ingredient and the sheath ingredient were melted at 295° C. and 280° C., respectively, and were composited with each other into a concentric core-sheath type having a circular cross section in a core/sheath ratio of 80/20 by mass and extruded from fine holes at a spinneret temperature of 300° C. Thereafter, the extrudate was spun with an air sucker at a spinning speed of 4,300 m/min to obtain thermoplastic continuous filaments. The filaments were passed through a nozzle which was continuously rocked over 36 degrees on each of the left-hand side and right-hand side to the web running direction, and were caused to collide against a metallic collision plate disposed at the outlet of the nozzle, thereby charged due to frictional electrification to be spread, and then collected on a moving net conveyor to form a fibrous web. The running speed of the net conveyor was regulated so that the fibrous web being thus formed by the collection had a mass per unit area of 60 g/m$^2$.

(Thermocompression Bonding)

The fibrous web was thermocompression-bonded with a pair of vertically arranged flat rolls at a flat roll surface temperature of 160° C. and a linear pressure of 588 N/cm, and the resultant compression-bonded sheet after the heat-press-bonding part was successively brought into contact with the surface of one of the flat rolls over a length of 120 cm for 1.9 seconds.

Through the treatment, a spunbonded nonwoven fabric having a fiber diameter of 14 μm and a mass per unit area of 60 g/m$^2$ was obtained. The thus-obtained nonwoven fabric for curtains had an air permeability of 90 cc/cm$^2$/sec, a thickness of 0.15 mm, a surface roughness SMD of the smooth surface of 0.90 μm, a machine-direction tear strength per mass per unit area of 1.00 N/(g/m$^2$), and a coefficient of variation in transmitted-light luminance of 20%, and the surfaces thereof included no parts where fibers had been fused to each other to become filmy other than fiber intersections.

Example 2

A fibrous web was obtained in the same manner as in Example 1, except that the running speed of the net conveyor was regulated so as to result in a mass per unit area of 70 g/m$^2$. This fibrous web was thermocompression-bonded with a pair of vertically arranged flat rolls at a flat roll surface temperature of 160° C. and a linear pressure of 588 N/cm, and the resultant press-bonded sheet after the heat-press-bonding part was successively brought into contact with the surface of one of the flat rolls over a length of 120 cm for 2.3 seconds.

The thus-obtained nonwoven fabric for curtains of Example 2 had an air permeability of 85 cc/cm$^2$/sec, a thickness of 0.20 mm, a surface roughness SMD of the smooth surface of 0.85 μm, a machine-direction tear strength per mass per unit area of 0.64 N/(g/m$^2$), and a coefficient of variation in transmitted-light luminance of 18%, and the surfaces thereof included no parts where fibers had been fused to each other to become filmy other than fiber intersections.

Example 3

A fibrous web was obtained in the same manner as in Example 1, except that the running speed of the net conveyor was regulated so as to result in a mass per unit area of 80 g/m$^2$. This fibrous web was thermocompression-bonded with a pair of vertically arranged flat rolls at a flat roll surface temperature of 160° C. and a linear pressure of 588 N/cm, and the resultant press-bonded sheet after the heat-press-bonding part was successively brought into contact with the surface of one of the flat rolls over a length of 120 cm for 2.6 seconds.

The thus-obtained nonwoven fabric for curtains of Example 3 had an air permeability of 68 cc/cm$^2$/sec, a thickness of 0.23 mm, a surface roughness SMD of the smooth surface of μm, a machine-direction tear strength per mass per unit area of 0.93 N/(g/m$^2$), and a coefficient of variation in transmitted-light luminance of 15%, and the surfaces thereof included no parts where fibers had been fused to each other to become filmy other than fiber intersections.

Comparative Example 1

A fibrous web was obtained in the same manner as in Example 1, except that the running speed of the net conveyor was regulated so as to result in a mass per unit area of 90 g/m$^2$. This fibrous web was thermocompression-bonded with a pair of vertically arranged flat rolls at a flat roll surface temperature of 180° C. and a linear pressure of 588 N/cm.

Through the treatment, a spunbonded nonwoven fabric having a fiber diameter of 14 μm and a mass per unit area of 90 g/m$^2$ was obtained.

The thus-obtained nonwoven fabric for curtains had an air permeability of 2 cc/cm$^2$/sec, a thickness of 0.11 mm, a surface roughness SMD of the smooth surface of 0.98 μm, a machine-direction tear strength per mass per unit area of 0.06 N/(g/m$^2$), and a coefficient of variation in transmitted-light luminance of 9%, and the surfaces thereof included parts where fibers had been fused to each other to become filmy other than fiber intersections.

Comparative Example 2

A fibrous web was obtained in the same manner as in Example 1. This fibrous web was thermocompression-bonded with a pair of vertically arranged flat rolls at a flat roll surface temperature of 160° C. and a linear pressure of 588 N/cm, and the resultant press-bonded sheet after the heat-press-bonding part was successively brought into contact with the surface of one of the flat rolls over a length of 120 cm for 2.9 seconds and then subjected to a partial thermocompression-bonding with an embossing roll to obtain a spunbonded nonwoven fabric having a fiber diameter of 14 μm and a mass per unit area of 80 g/m$^2$. The thus-obtained nonwoven fabric for curtains had an air permeability of 70 cc/cm$^2$/sec, a thickness of 0.29 mm, a surface roughness SMD of the smooth surface of 2.32 μm, a machine-direction tear strength per mass per unit area of 1.27 N/(g/m$^2$), and a coefficient of variation in transmitted-light luminance of 25%, and included no parts where fibers had been fused to each other to become filmy other than fiber intersections.

TABLE 1

| | | Ex. 1 | Ex. 2 | Ex. 3 | Comparative Ex. 1 | Comparative Ex. 2 |
|---|---|---|---|---|---|---|
| Thermoplastic polymers | High-melting-point long fibers | PET | PET | PET | PET | PET |
| | Low-melting-point long fibers | co-PET | co-PET | co-PET | co-PET | co-PET |

TABLE 1-continued

| | | Ex. 1 | Ex. 2 | Ex. 3 | Comparative Ex. 1 | Comparative Ex. 2 |
|---|---|---|---|---|---|---|
| Smoothing treatment | Contact distance (cm) | 120 | 120 | 120 | — | 120 |
| | Contact time (sec) | 1.9 | 2.3 | 2.6 | — | 2.6 |
| Embossing | Linear pressure (kgf/cm) | — | — | — | — | 70 |
| | Temperature (° C.) | — | — | — | — | 200 |
| | Speed (m/min) | — | — | — | — | 22 |
| Mass per unit area (g/m$^2$) | | 60 | 70 | 80 | 90 | 80 |
| Air permeability (cc/cm$^2$/sec) | | 90 | 85 | 68 | 2 | 70 |
| Thickness (mm) | | 0.15 | 0.20 | 0.23 | 0.11 | 0.29 |
| Surface roughness of smooth surface (μm) | | 0.90 | 0.85 | 0.75 | 0.98 | 2.32 |
| Machine-direction tear strength per mass per unit area (N/(g/m$^2$)) | | 1.00 | 0.64 | 0.93 | 0.06 | 1.27 |
| Coefficient of variation in transmitted-light luminance (%) | | 20 | 18 | 15 | 9 | 25 |
| Filmy state due to fusion of fibers (present/absent) | | absent | absent | absent | present | absent |

(Remarks)
PET: poly(ethylene terephthalate) resin
co-PET: poly(ethylene terephthalate) copolymer resin <Conclusion>

As Table 1 shows, nonwoven fabrics for curtain use which hardly produced fuzz, had moderate light-shielding properties and light-transmitting properties, and had excellent mechanical strength were obtained by forming each nonwoven fabric so as to include fibers including a thermoplastic resin as a main component, in which, in a surface of the nonwoven fabric, fibers had been fused to each other in fiber intersections and the fibers were apart from each other in areas other than fiber intersections, at least one sheet surface of the nonwoven fabric had a surface roughness SMD determined by KES-method of 1.2 μm or less and the nonwoven fabric had a machine-direction tear strength per mass per unit area of 0.50 N/(g/m$^2$) or higher.

Meanwhile, as Table 1 shows, the nonwoven fabric for curtains of Comparative Example 1, although satisfactory in terms of the surface roughness SMD determined by KES-method of the smooth surface, had low machine-direction tear strength per mass per unit area, poor mechanical strength, low coefficient of variation in transmitted-light luminance, and poor light-transmitting properties. In addition, in some parts other than fiber intersections, fibers had been fused to each other to become filmy.

The nonwoven fabric for curtains of Comparative Example 2 had a high machine-direction tear strength per mass per unit area, excellent mechanical strength, satisfactory transmitted-light luminance, and excellent light-transmitting properties, but the smooth surface thereof was poor in surface roughness.

While the invention has been described in detail and with reference to specific embodiments thereof, it will be apparent to one skilled in the art that various changes and modifications can be made therein without departing from the aim and scope thereof. This application is based on a Japanese patent application filed on May 31, 2018 (Application No. 2018-104588), the entire contents thereof being incorporated herein by reference.

INDUSTRIAL APPLICABILITY

Since the nonwoven fabric for curtains according to one aspect of the present invention hardly produces fuzz, has moderate light-shielding properties and light-transmitting properties, and has excellent mechanical strength, this nonwoven fabric is suitable for use not only as indoor curtains such as blind curtains, roll-up curtains, and pleated curtains but also in a wide range of fields.

REFERENCE SIGNS LIST

1: Fibrous web
2: Heat-press-bonding part
3: Contact part of nonwoven fabric and flat roll
4*a*: Upper roll
4*b*: Lower roll
5: Arrow indicating running direction of fibrous web

The invention claimed is:

1. A nonwoven fabric for curtains, the nonwoven fabric comprising fibers comprising a thermoplastic resin as a main component, wherein, in a surface of the nonwoven fabric, the fibers are fused to each other in intersections of the fibers and the fibers are apart from each other in parts other than the intersections, at least one sheet surface of the nonwoven fabric has a KES surface roughness SMD of 1.2 μm or less, and the nonwoven fabric has a machine-direction tear strength per mass per unit area of 0.50 N/(g/m$^2$) or higher.

2. The nonwoven fabric for curtains according to claim 1, having a mass per unit area of 50 g/m$^2$ or larger and 100 g/m$^2$ or smaller, a thickness of 0.10 mm or larger and 0.25 mm or smaller, an air permeability of 30 cc/cm$^2$/sec or higher and 120 cc/cm$^2$/sec or lower, and a coefficient of variation in transmitted-light luminance of 10% or higher and 30% or lower.

3. The nonwoven fabric for curtains according to claim 1, being a spunbonded nonwoven fabric comprising long fibers.

4. A method for producing the nonwoven fabric for curtains according to claim 1, the method comprising a step of thermocompression-bonding a fibrous web at a linear pressure of 500 N/cm or higher and 1,100 N/cm or lower with a pair of flat rolls heated to a temperature lower by 30° C. or higher and 120° C. or lower than a melting point of a thermoplastic resin which has the lowest melting point and constitutes a surface of the fibers to obtain a nonwoven fabric, and then successively bringing the nonwoven fabric into contact with the flat roll for a certain time period.

* * * * *